US009890007B2

(12) United States Patent
Laitio et al.

(10) Patent No.: US 9,890,007 B2
(45) Date of Patent: Feb. 13, 2018

(54) DEVICE AND METHOD FOR MANIPULATING A FIBROUS WEB

(71) Applicants: Juha Laitio, Espoo (FI); Markku Nieminen, Vantaa (FI)

(72) Inventors: Juha Laitio, Espoo (FI); Markku Nieminen, Vantaa (FI)

(73) Assignee: TAKSO Software Ltd, Helsinki (FI)

( * ) Notice: Subject to any disclaimer, the term of this patent is extended or adjusted under 35 U.S.C. 154(b) by 36 days.

(21) Appl. No.: 14/994,285

(22) Filed: Jan. 13, 2016

(65) Prior Publication Data

US 2016/0207728 A1 Jul. 21, 2016

(30) Foreign Application Priority Data

Jan. 14, 2015 (FI) ..... 20150012

(51) Int. Cl.
*B65H 20/14* (2006.01)
*D21G 9/00* (2006.01)

(52) U.S. Cl.
CPC ..... *B65H 20/14* (2013.01); *D21G 9/0063* (2013.01); *B65H 2301/51514* (2013.01);
(Continued)

(58) Field of Classification Search
CPC ..... D21G 9/0063; B65H 20/14; B65H 2301/51514; B65H 2301/51533;
(Continued)

(56) References Cited

U.S. PATENT DOCUMENTS 3,316,657 A * 5/1967 Haywood ..... D21F 1/32 222/637
4,201,323 A * 5/1980 Stibbe ..... B65H 23/24 242/615.11

(Continued)

FOREIGN PATENT DOCUMENTS

FI 20146017 A A1 12/2014
GB 2099912 A A1 12/1982

OTHER PUBLICATIONS

FI10712 U (Valmet Technologies Inc [FI]) Dec. 5, 2014 (Dec. 5, 2014), Finland. This is special "utility model" that is also called as "petty patent". It is a special publication format and type in Finland. The whole document is valid, particularly from p. 7 line 16 to p. 8 line 3, and figures 2 and 3a.

*Primary Examiner* — Kenneth E. Peterson
*Assistant Examiner* — Fernando Ayala

(57) ABSTRACT

The invention relates to a device and a method for manipulating a fibrous web (10). The device comprises at least one blower (21A, 21B) provided with a flow-preventing element (24A, 24B) which is arranged to produce at least one blow (26A, 26B) substantially in the direction of the fibrous web (10), and a friction element (28) against which the fibrous web (10) is arranged to be pressed at least partially from the effect of said blow (26A, 26B) and flow-preventing element (24A, 24B) to apply a friction force resisting the motion of the fibrous web (10) to the fibrous web (10). According to the invention, the blow (26A, 26B) is directed substantially away from the friction element (28) and the friction element (28) comprises a surface profile which is arranged such that, from the effect of said at least one blow (26A, 26B), a continuous vacuum is created on the surface of the fibrous web (10) on the side of the friction element (28). Due to its intensified friction effect, the device according to the invention is applicable especially for board and, by means of it, it (Continued)

is possible to form e.g. an air cutting device in the tail-threading section of a board machine.

8 Claims, 7 Drawing Sheets

(52) U.S. Cl.
CPC ..... *B65H 2301/51533* (2013.01); *B65H 2301/522* (2013.01); *B65H 2801/84* (2013.01); *Y10T 83/0591* (2015.04); *Y10T 225/35* (2015.04)

(58) Field of Classification Search
CPC ..... B65H 2301/522; B65H 2801/84; Y10T 225/35; Y10T 83/0591
USPC ..... 225/100
See application file for complete search history.

(56) References Cited

U.S. PATENT DOCUMENTS 4,350,310 A * 9/1982 Frohling ..... B65H 23/10 226/39
4,472,888 A * 9/1984 Spiller ..... B41F 23/0426 226/196.1
4,501,643 A 2/1985 Kiuru
5,322,650 A * 6/1994 Endo ..... C03B 19/1045 264/11
5,606,805 A * 3/1997 Meyer ..... F26B 3/305 34/267
6,543,765 B2 * 4/2003 Kerpe ..... B41F 21/00 271/195
6,743,338 B2 * 6/2004 Graeffe et al. ..... G01B 11/0691 162/198
6,840,165 B1 * 1/2005 Leppakoski ..... D21G 1/002 100/168
6,936,137 B2 * 8/2005 Moeller ..... B65H 20/14 162/193
7,117,775 B2 10/2006 Broom
7,513,499 B2 * 4/2009 Muller ..... B65H 29/245 101/232
7,892,399 B2 * 2/2011 Graham ..... B65H 23/24 162/193
8,083,896 B2 * 12/2011 Hughes ..... B65H 20/14 162/263
2002/0078842 A1 * 6/2002 Frankenberger ..... B41F 21/00 101/232
2003/0078151 A1 * 4/2003 Weder ..... A41G 1/009 493/463
2009/0123681 A1 * 5/2009 Weder ..... A41G 1/009 428/35.7

* cited by examiner

DEVICE AND METHOD FOR MANIPULATING A FIBROUS WEB

FIELD OF INVENTION

The invention relates to a device and a method for manipulating a fibrous web. Such a device and method can be used in a fibrous-web machine and particularly in its threading section. The invention especially relates to a device and method for cutting a fibrous web in the tail-threading of a paper or board machine.

BACKGROUND OF INVENTION

Commonly in a fibrous-web machine, such as a paper or board manufacturing machine, tail-threading is performed at the normal run speed of the machine. Tail-threading is started from a point in which typically a full-width web is dropped down from a rotating machine element, such as a roll or a dryer, to broke handling, i.e. typically to a pulper or a broke conveyor, by cutting to the web a narrow tail suitable for tail-threading by special cutting devices, which tail also falls before the start of tail-threading to the broke handling similar to the other web. Disadvantageous rotating of the web and the tail around said roll is typically prevented by a doctor knife i.e. trailing knife on the roll surface. The tail-cutting devices affect the run of the tail by cutting it and by directing the new cut tip of the tail to a new path to be conveyed further by other tail-threading devices to a path of the web travelling through the subsequent section of the paper and board manufacturing machine. In this description, the roll side of the tail is referred to as the back side of the tail and the other side its front side. At the front side of the tail, a subsequent section of the paper and board manufacturing machine is located and the tail-threading is performed through it. When the narrow tail has been conveyed through said machine section, it is widened into a full-width web by moving the cutting device by which the tail was formed in the cross machine direction.

There are many and different known tail-cutting devices because the run speed of the fibrous-web machine and the properties of the fiber to be cut, such as paper or board, set very different requirements for the cutting device. The difference between paper and board is not strict but commonly boards are thick and thus flexurally bending stiff compared with paper. Often, the speed of paper machines is also higher than that of board machines.

One type of a cutting device in a paper machine is an air cutting device, by means of which, the tail is released from the surface of the rotating roll before said point in the knife of the doctor knife by blowing air by the so-called releasing blow between the tail and the roll. In the release point of the tail, there is simultaneously arranged a narrow gap between the air cutting device and the roll, whereby the loop of the tail releasing from the roll surface hits the corner of the air cutting device and the upper surface of the device. Close to the corner and on the upper surface of the device, there is arranged an intensive blow blowing away from the roll and the tail enters within the range of a vacuum created by this blow. This blow, which often referred to as the cut-off blow, is typically provided by means of compressed air discharging via a row of holes from a nozzle chamber. The discharging air causes an intensive vacuum at the point of the nozzle holes and the tail is sucked fast in the strongly turbulent nozzle flow which breaks the tail i.e. simultaneously cuts said loop of the tail and the connection between the tail and the tail section going to broke handling. The cut new tip of the tail starts to run in the direction of the cut-off blow and towards the subsequent tail-threading devices. In practice, the operation of the device has been boosted by arranging a similar intensive air blow close to the tail such that the blow aims at conveying the moving tail into the direction preceding cutting towards broke handling. This blow, which is often referred to as a holding-down blow, is positioned in the travel direction of the tail after the said forming loop of the tail and, when the loop comes within the range of the vacuum of cut-off blow, the holding-down blow forms in the tail a force affecting in the opposite direction in relation to the cut-off blow, which in the best case momentarily stops the tail having previously travelled at the run speed of the paper machine. The tail having stopped at the point of the nozzle of the cut-off blow is cut considerably more quickly than the moving tail. The functionality of this type of a cutting device becomes weakened as the rigidity stiffness of paper increases and generally this device is not suitable for cutting board. A more rigid tail will not be released into a loop from the surface of the rotating roll by means of the release blow and the tail will not curve sufficiently to enter within the range of the vacuum of the cut-off blow nozzle.

In board machines, the tail is typically cut between various cutting knives or by guiding the tail against rotating knives. In cutting devices, there is typically a turning cut-off plate, at the tip of which there is the other half of the cut-off knife pair, on the same side of the tail as said rotating roll of which the tail will fall down towards broke handling i.e. on the backside. Before the cutting event, the cut-off plate is directed substantially towards broke handling thus disturbing the run of the tail as little as possible. As the cut-off plate typically turns forward and upward towards the subsequent tail-threading devices at the front of the tail, the cut-off knife of the cut-off plate tip passes by a stationary counter knife, whereby the tail is cut between the knives and the connection between the tail and the tail section going to broke handling is cut.

Another typical structure used is a turning cut-off plate without the knife at its tip when there are quickly rotating knives in place of the counter knife. The cut new tail tip starts travelling into the direction according to the position of the cut-off plate after the cutting moment towards the subsequent tail-threading devices. Typically, there are arranged air blows before the cut-off plate above it, to the cut-off plate itself and after the stationary counter knife, from the effect of which, air blows the travel of the cut tail into the desired direction is more reliable. Due to the location of the device on the same side as the moving roll i.e. at the backside of the tail, the device must be typically located disadvantageously below the doctor knife of the roll. In some cases, lack of available space still prevents the location of the cutting device below the doctor knife, whereby alternative ways must be introduced. However, board cutting has been proved most reliable by devices of the type described above and devices located above the doctor knife are avoided if possible. Such an alternative solution is a combination of a miniature doctor knife, a holding-down blow and a stationary cut-off knife being at its tip pushing under the tail along the roll surface. The cutting is performed in the way of scissors by means of a cut-off knife turning from the front of the tail. It is also typical of known cutting devices that there is precisely designed timing of different blows and motions in relation to each other, which enables their automatic operation.

As a summary, it can be stated that known cutting devices particularly designed for board require a lot of space in the tail-threading section of a fibrous-web machine and are thus awkward to locate or, on the other hand, are relatively complex to implement.

Therefore, there is requirement for improved manipulation devices of fibrous webs and particularly for cutting devices of board webs in the tail-threading section of a board machine.

SUMMARY OF INVENTION

The object of the invention is to introduce an improved device for manipulating fibrous webs and particularly relatively rigid board webs. A particular object is to provide an air cutting device simpler than known arrangements. A further object is also to provide a device which fits into a smaller space than known arrangements and/or a device which can be more freely located in the tail-threading apparatus of a fibrous-web machine, particularly a board machine.

The object of the invention is also to introduce an equivalent method for manipulating a fibrous web, particularly for cutting it for tail-threading.

The basic idea of the invention is to utilize the gas flow, typically air flow, of a blower guiding the fibrous web in order to increase friction in a friction element located in the vicinity of the blower against which element the fibrous web is pressed when the blower operates. Particularly, a friction element is utilized which is provided with a flow-preventing element, such as a flow-preventing plate, located in the vicinity of blow openings of the blower, which friction element is arranged to create a vacuum between the friction element and the fibrous web. The vacuum is provided by the flow-preventing plate of the blower which prevents the supply of make-up air from the other side of the blow openings seen from the web and, on the other hand, by a surface profile of the friction element which allows an air flow directed mainly in the direction of the blow from the area of the friction element. In other words, the blower creates suction directed at the friction element in the fibrous web. Particularly, the surface profile can be such that the friction element forms a discontinuous contact with the fibrous web, whereby there remains an air channel or air channels between it and the fibrous web. Hence, a continuous vacuum can thus be provided i.e. it stays on also when the fibrous web is pressed against the friction element. Particularly, the friction element and the blower are located such in relation to each other that the blow is substantially directed away from the friction element.

The device according to the invention comprises a first and a second blower provided with a flow-preventing element which are arranged to produce blows, typically air jets, against the motion direction of the fibrous web and in the motion direction of the fibrous web, respectively, and at least mainly in the direction of the fibrous web against the plane of the fibrous web in order to apply a perpendicular force component to the fibrous web, and a friction element against which the fibrous web is arranged to be pressed partially from the effect of said force component to apply a friction force resisting the motion of the fibrous web. According to the invention, the friction element comprises a surface profile which is shaped such that said blows cause a vacuum on the surface of the fibrous web being on the side of the friction element, typically between the fibrous web and the friction element. The vacuum intensifies the pressing of the fibrous web against the friction element and thus further increases said friction force.

In the method according to the invention, the fibrous web is conveyed in the vicinity of blowers of said type such that blows produced by the blowers produce a force component to the fibrous web perpendicular against the plane of the fibrous web, and friction force resisting its motion is applied to the fibrous web by a friction element which is located in the vicinity of said blowers such that the blows create a continuous vacuum on the surface of the fibrous web on the side of the friction element.

According to the invention, the friction element is located between the first and the second blower, whereby blows are directed substantially away from said friction element such that at least the most part of the friction element is located on the backside of a plane defined by the outlet opening and/or openings and the start direction of each blow, and the friction element comprises a surface profile deviating from a planar one which is arranged such that, from the effect of said blows and flow-preventing elements, a continuous vacuum is provided on the surface of the fibrous web on the side of the friction element.

In this context, manipulating the fibrous web particularly refers to the guiding, tightening, decelerating, stopping and/or cutting of the fibrous web or its part.

In more detail, the device and method according to the invention are characterized in what is said in the independent claims.

The invention provides considerable advantages. First, because the fibrous web is pressed against the friction element due to the vacuum with a greater force, friction between them increases, which enables more efficient manipulation of the fibrous web particularly in the tail-threading process. For the same reason, the invention is also applicable for manipulating board webs which are more rigid than paper webs and thus less guidable. Second, it is possible to implement by means of the invention an air cutting device fitting into a smaller space. Particularly, the whole device assembly cutting the fibrous web can be implemented as one unit as later will be described. Third, a tail-threading apparatus or some other manipulation apparatus of a fibrous web, a part of which the present device is in each case, can be provided considerably simpler. The device can be totally located on one side of the web, which simplifies the apparatuses.

The device according to the invention can thus be used as an arrangement in the tail-threading section of the fibrous-web machine as part of the tail-threading apparatus. By means of it, a rigid board web can be cut by sole air blows in the purpose of tail-threading. The advantage of the arrangement is that board can be cut by only using air blows instead of mechanical moving knives, which in addition to being simple also increases safety. The apparatus can be implemented light-structured compared with arrangements cutting by means of knives. Particularly, it can be located relatively high in relation to the roll from which the tail falls, even on the level of the doctor knife or above it.

The invention is also applicable for manipulating and particularly cutting paper webs in addition to board.

Other advantages of the invention are described in more detail later in connection with the depiction of embodiments.

The dependent claims deal with selected advantageous embodiments.

According to an embodiment, a vacuum is arranged to be formed at least mainly between the fibrous web and the friction element. Then, the surface profile of the friction element forms a discontinuous contact with the fibrous web.

According to another embodiment, the surface profile of the friction element comprises several projections against which the fibrous web is arranged to be pressed and between which then remains an air channel for maintaining said vacuum. There can have been arranged projections on the surface of the friction element in two dimensions, as will be later described, or at least in one of these dimensions. The most powerful effect can be provided when there are projections in two directions.

According to a further embodiment, the projections are fastened to a base element which comprises a plate in the direction of the plane of the fibrous web.

In addition to or instead of projections, it is possible to use other surface profile elements which make the surface of the friction element different from a planar one. The surface profile elements can also comprise openings.

In addition to the projections or other surface profile elements keeping the fibrous web partially loose from the surface of the friction element and enabling the creation and continuous maintenance of a vacuum, they can themselves increase the roughness (on micro and/or macro level) of the surface of the friction element, which further intensifies the friction effect.

According to an embodiment, a vacuum is arranged to be created on the opposite side of the friction element than the side on which the fibrous web is pressed to it. Then, there are openings in the friction element via which openings the fibrous web 'is sucked' against the friction element.

According to another embodiment, the object of the invention is an arrangement for tail cutting, which arrangement includes at least two blowers substantially affecting the tail in the opposite direction for cutting the tail, whereby both blowers are provided with flow-preventing plates, and a friction element arranged between the blowers. The friction element is arranged to lift the tail away from the surface of the device such that it forms a discontinuous contact with the tail. According to an advantageous variation described in more detail later, the friction element lets air flow between a common air chamber of the tail and the blowers.

In more detail, an air cutting device according to an embodiment comprises two blowers, i.e. a first blower for producing a first air jet substantially at least mainly against the motion direction of the fibrous web and a second blower for producing a second air jet at least mainly in the motion direction of the fibrous web. The friction element is located in the motion direction of the fibrous web between said first and second blower such that both the first and the second air jet create said vacuum. Both blowers can provide suction from the same space, which intensifies the pressing of the fibrous web against the friction element and thus the friction effect. Such an arrangement is advantageous particularly in an air cutting device in which the substantially stopping friction effect of the fibrous web is desired in order to enable air cutting. Especially in such a device, the first and the second blower are arranged to produce air jets substantially equal of their intensity.

According to an embodiment, said first and second blower comprise a common air-supply channel and said friction element is arranged substantially between the common air-supply channel and the fibrous web. Such an arrangement enables a particularly small-sized effective air cutting device.

According to the invention, utilized blowers are provided with a flow-preventing element the task of which is to limit the supply of make-up air at least from one side of the outlet openings, whereby the supply of make-up air from the vicinity of the surface profile of the friction element increases substantially, which causes a vacuum increasing friction according to the invention. Typically, a flow-preventing plate which is set in the direction of the blow is used or one curved away from it and/or set at an angular position. The curved plates and/or ones set at an angular position further cause a force component pressing the fibrous web towards the device at least partially due to the Coanda effect. Particularly, plates set at an angular position in relation to the travel direction of the web can guide the already cut web into a desired direction, because the plates divert the air flow due to the Coanda effect.

The fibrous web can be a paper or board web. The invention is particularly advantageously applicable for manipulating a board web, the previously known arrangements used for the manipulating of which have been complex and/or large-sized.

'In the direction of the fibrous web' refers here to the machine direction. The motion or travel direction of the fibrous web refers to the direction of the fibrous web into which the web proceeds and the opposite direction to the motion or travel direction refers to its opposite direction. The width refers here to the perpendicular direction to the machine direction on the plane of the web.

Blows arranged 'substantially' or 'at least mainly' in the direction of the fibrous web (or in its motion direction or against its motion direction) refer to blows deviating at the most 45 degrees from the direction in question on the plane of the fibrous web and/or out of its plane. Here, the reference is to the start direction of blows (the direction in the immediate vicinity of the blow nozzles). The blows can change direction ('be curved') e.g. due to air controls and/or the Coanda effect.

The blow being directed substantially away from the friction element refers to a situation in which most part of the friction element, advantageously the whole friction element, is located on the backside of a plane defined by the outlet opening/openings and start direction of the blow, i.e. on the other side to that to which the blow is directed.

A flow-preventing element refers to an element which prevents the supply of make-up air in the vicinity of the blow from the side of blow openings opposite to that where the web and the friction element are located. Such an element is particularly a plate arranged in the vicinity of the blow opening in the start direction of the blow or advantageously at the most 45 degrees deviating from this direction.

A vacuum on the surface of the fibrous web on the side of the friction element (the front surface) refers to pressure smaller than the one prevailing on its opposite surface (the back surface) which is caused at least partially from the combined effect of air jet(s) in the direction of the fibrous web and the mutual location(s) of the friction element and the surface profile of the friction element. The vacuum causes the intensified pressing of the web against the friction element.

Next, the embodiments of the invention and their advantages will be described in more detail with reference to the attached drawings.

DETAILED DESCRIPTION OF EMBODIMENTS

Figure 1A:
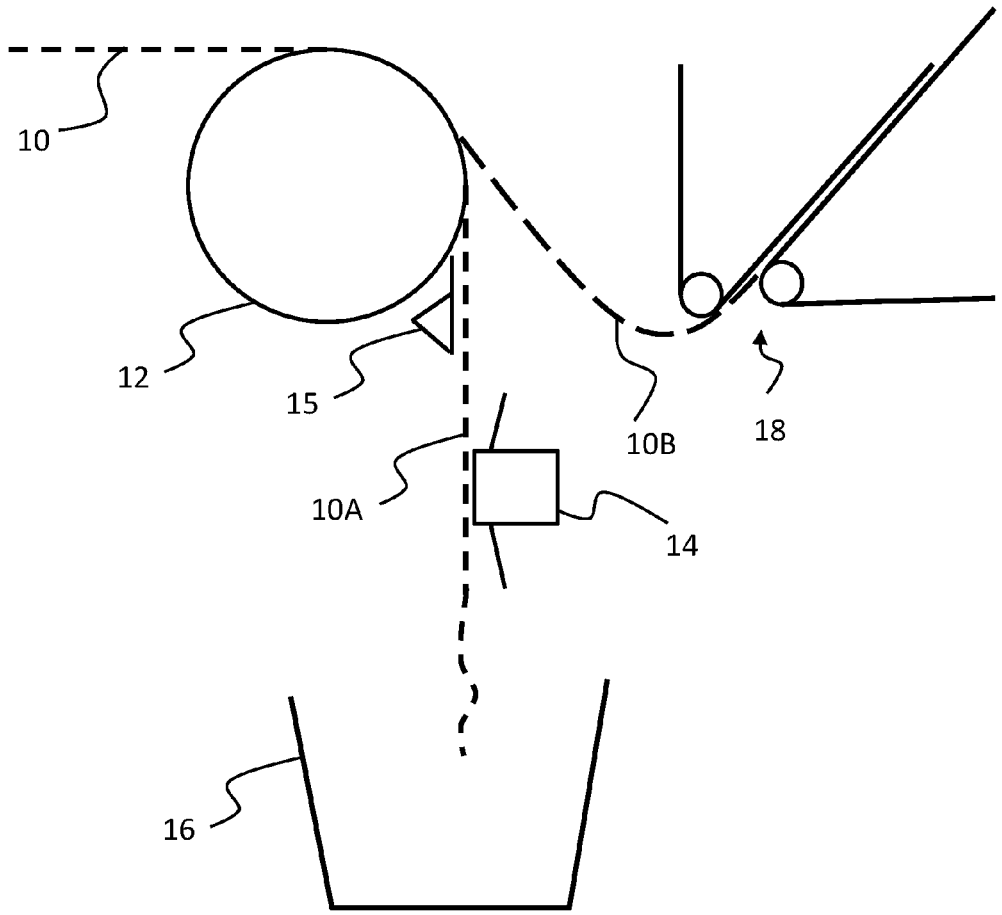
FIG. 1A shows a schematic cross-sectional side view of the basic principle of tail-threading of a fibrous web in a fibrous-web machine utilizing an air cutting device according to the invention.

FIG. 1A shows the basic principle of the tail-threading of a paper or board machine according to a possible implementation utilizing the present invention. A fibrous web 10 is supplied onto a roll 12 from which it falls into a broke-handling device 16, such as a pulper. The web releases from the roll 12 at the latest when hitting a doctor knife 15. A tail 10A has been separated from the web by cutting before the release of the web from the roll. An air cutting device 14 according to an embodiment of the invention is located on the front side of the tail 10A close to the falling web.

FIG. 1A also shows the situation after cutting when a tail 10B has been cut by the air cutting device 14 and brought to a rope nip 18 or some other apparatus controllably receiving the tail 10B for guiding it to further processing. Bringing the tail 10A having been cut in the vicinity of the air cutting device 14 to a receiving apparatus can be implemented by a method known as such in the field which were briefly described above and will not be depicted here in more detail. One such an apparatus is known e.g. from patent specification FI123973B.

Figure 1B:
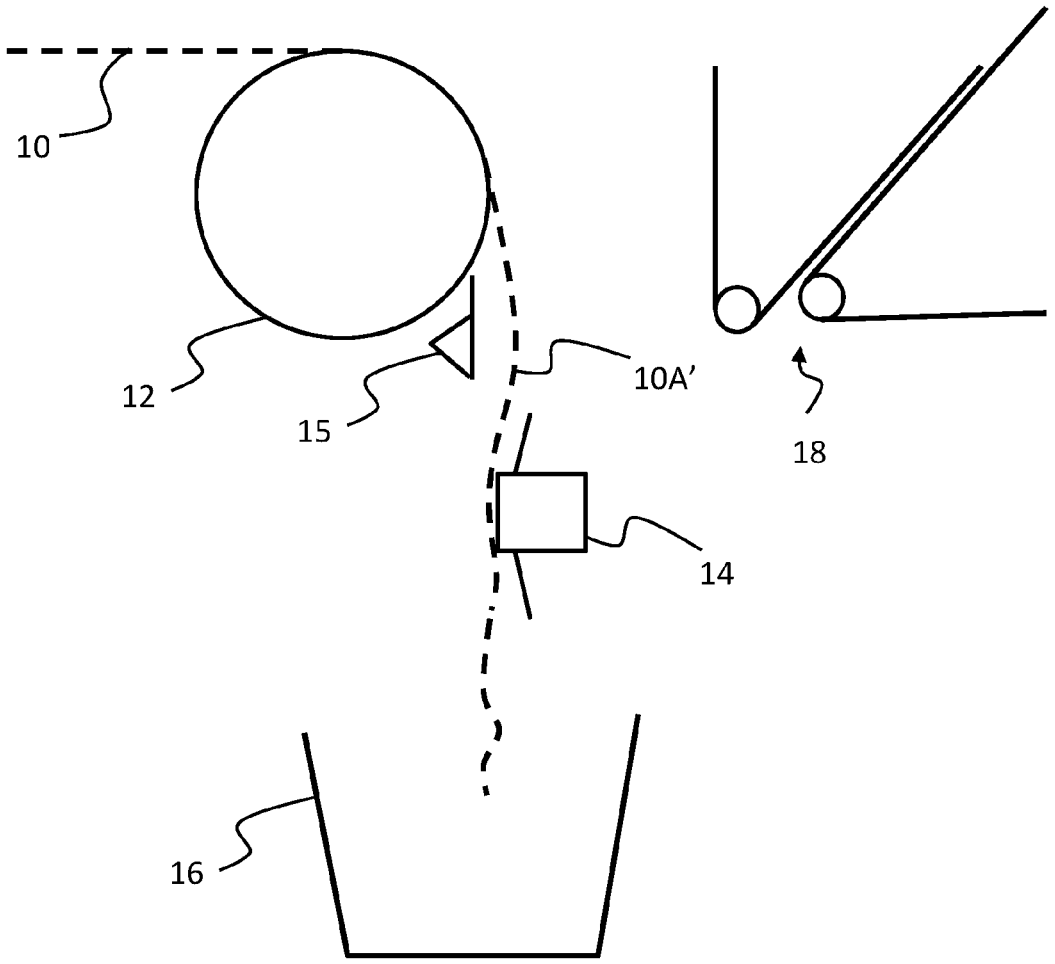
FIG. 1B shows in more detail an air cutting arrangement of a fibrous web according to an embodiment.

FIG. 1B shows an arrangement corresponding to that of FIG. 1A in which, however, the travel of a web 10A', due to the device 14 being in operation, has started to decelerate in the area of the device 14 and thus started to bulge above that towards the further-processing apparatus 18. Hence, FIG. 1B shows an intermediate situation between the positions of the webs 10A and 10B of FIG. 1A.

In FIGS. 1A and 1B, the device is located below the plane of the doctor knife, but it can also be located on its plane or even above it. In more detail, the horizontal centre line of the device in such an arrangement is on the level of the lowest plane of the doctor knife or even on the level of its topmost plane (doctoring plane) or above it.

Next, an air cutting device according to an embodiment will be described in more detail with reference to FIG. 2A. Generally, the device comprises two blowers 21A, 21B i.e. it is arranged to produce two blows 26A, 26B, that is, a cut-off blow 26A and a holding-down blow 26B, of which one, in this case the blow 26B, is directed substantially in the travel direction of the tail 10 and the other, the blow 26A, substantially opposite to the travel direction of the tail 10.

Figure 2A:
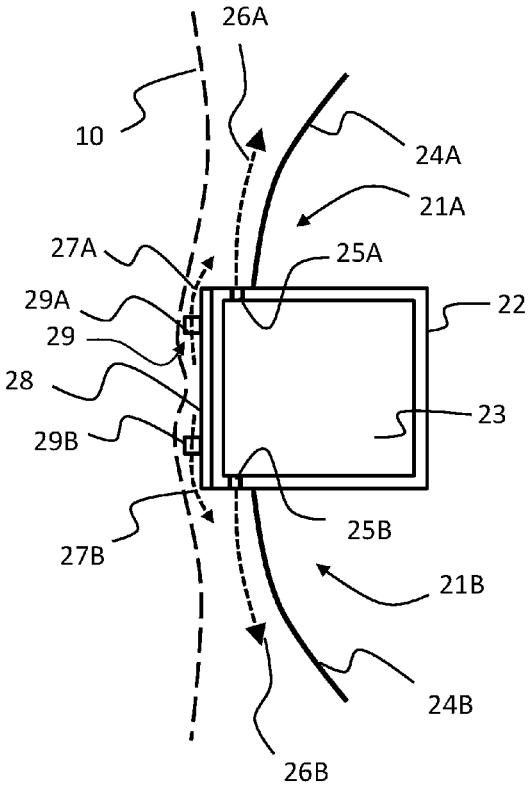
FIGS. 2A and 2B show cross-sectional side views of devices according to the present invention in accordance with two alternative embodiments.

In more detail, the device illustrated in FIG. 2A comprises a frame 22 which forms an air chamber 23. On the opposite sides of the chamber, for each are arranged one or advantageously several air openings 25A, 25B i.e. nozzles such that, when pressurizing the chamber 23, air jets i.e. cut-off and holding-down blows 26A, 26B, respectively, are formed from the air openings 25A, 25B. Compressed air can be produced e.g. by a compressor (not shown in the figures). Advantageously, the start directions of the air jets 26A, 26B are substantially in the direction of the web 10 and opposite or mainly opposite to each other. An angle between the start directions of the jets can be e.g. 90 . . . 200 degrees, typically 180 degrees. On each side, the air openings 25A, 26B can comprise e.g. a bank of openings in the direction of the web, perpendicular in relation to the plane of FIG. 2A, or equivalently one or more narrow slot-like openings.

Furthermore, the device is provided with flow-preventing plates 24A, 24B which are arranged on the opposite sides of the frame 22, in the vicinity of the air openings 25A, 25B, respectively. The plates 24A, 24B prevent the air jets 26A, 26B from receiving make-up air from an undesired direction and cause suction which pulls the fibrous web 10 towards the plates 24A, 24B and against the device. In this example, the plates 24A, 24B extend away from the air openings 25A, 25B at least partially obliquely in relation to the plane of the fibrous web, whereby they cause the so-called Coanda effect i.e. the curving of air jets 26A, 26B away from the fibrous web. The plates 24A, 24B can be straight or, as shown in FIG. 2A, curved. They can also be angular (straight in bits). The start direction of the plates can be in the direction of the blow or inclined e.g. for 0 . . . 45 degrees in relation to the start direction of the blow.

When the tail 10 is brought to the position shown in FIG. 2A, its travel decelerates or it even stops from the effect of two simultaneous and opposite blows, in this case from the effect of the blows 26A, 26B directed at opposite directions, when their strengths are appropriate. The substantial deceleration of the tail 10 leads to its intensive vibration in the flow of the blows, the breaking of fibers and further to the cutting of the whole tail 10. In the case of the present invention, this process occurs in a smaller area in the travel direction of the web compared with previous solutions and thus also extremely quickly and accurately, like described in more detail below.

To intensify the deceleration, stopping and thus also cutting of the web, a friction element 28 has been arranged according to the present invention on the side of the web of the frame 22 in FIG. 2A, in more detail in an area between the blow openings 25A, 25B, against which friction element the web 10 is pressed. The friction element 28 advantageously extends close to the outlet openings and lifts the tail 10 loose from the frame 22 of the chamber 23. The air jets 26A, 26B tend to get make-up air from all possible directions. One direction has been blocked in the arrangement by the flow-preventing plates 24A, 24B. Hence in the present arrangement, make-up air is extracted from a pocket zone formed by the tail 10, the flow-preventing plates 24A, 24B and the walls 22 of the chamber 23 and the friction element 28. By lifting the tail 10 at least partially loose of the chamber 22 by the friction element 28 and by arranging the friction element 28 substantially air permeable in the direction of the plane of the tail 10, the air jets 26A, 26B tend to get make-up air particularly between the tail 10 and the chamber 22. These make-up air flows are illustrated in FIG. 2A by arrows 27A, 27B. Then, at the front of the tail 10 is formed an intensive vacuum which presses the tail strongly against the friction element 28.

As seen in FIG. 2A, the friction element 28 is located totally at the back of the blows 26A, 26B i.e. the blows 26A, 26B are directed away from it. The desired vacuum effect is provided by the make-up air flows 27A, 27B created from the combined effect of the profile of the friction element 28, the blows 26A, 26B and the flow-preventing plates 24A, 24B.

According to an embodiment illustrated in FIG. 2A, the friction element 28 comprises a base plate and projections 29A, 29B extending from the base plate which first come into contact with the tail 10. A wall of the chamber 22 can also operate as the base plate. The projections 29A, 29B are arranged at a distance from each other such that air channels are formed between them (on a plane perpendicular to the one of the figure). Thus, the air jets 26A, 26B cause a continuous vacuum between the friction element and the web, which presses the tail 10 towards the friction element 28 and particularly its projections 29A, 29B more and more intensely. The increasing friction starts to decelerate the run of the tail 10. Finally, the force of the air jets 26A, 26B cuts the tail. If the air jets 26A, 26B are intensive enough, the friction force between the tail 10 and the friction element 28 is sufficient to stop the tail 10.

In the case of the friction element 28 provided with projections, the tail 10 tends to bulge according to FIG. 2A between the projections towards the friction element, which further intensifies the friction effect.

An advantageous way to form the friction element 28 is to manufacture holes directly on the wall of the nozzle chamber 22 or on a separate plate at a distance from each other and to fasten in the holes retainer screws the heads of which form the projections 29A, 29B. Such durable retainer screws are commonly available.

The distance between the projections 29A, 29B can be quite freely arranged. It can be e.g. 5-50 mm from one edge of the projection to that of the other. The height of the projections is advantageously 1-10 mm, typically 1-5 mm.

The vacuum is formed particularly high the tail 10 being wide in relation to the cross-sectional area of the pocket zone (the area between the web, the flow-preventing plate and the chamber) supplying make-up air. With typical tail widths, e.g. 10-40 cm, the vacuum and friction provided with the locations and dimensions of projections described above as examples and the flows of the air jets 26A, 26B provided by conventional techniques are sufficient to enable the cutting of the board solely by the force of the air jets. As the thickness of the board and simultaneously the rigidity of the tail 10 increase, the complete stopping of the tail 10 is advantageous because a short cutting time is then ensured. The increase in the rigidity of the tail 10 increases the force by which the tail is pressed against the friction element and thus also the friction force.

Figure 2B:
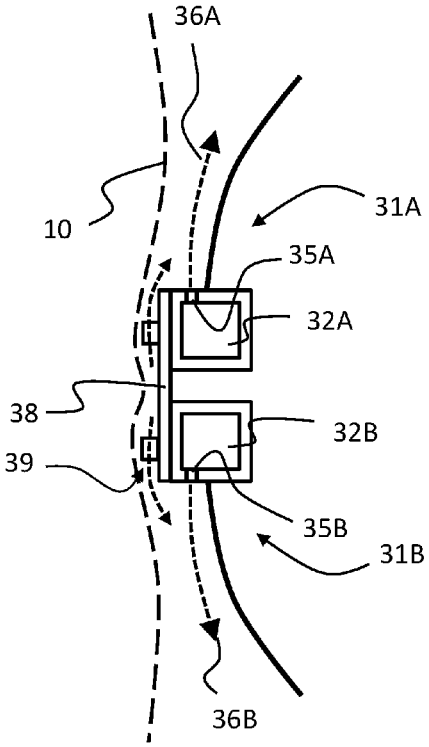

In the embodiment of FIG. 2A, the air openings 25A, 25B on both sides are arranged into connection with the same air chamber 23, which ensures equal jet pressure on both sides. FIG. 2B shows an alternative embodiment in which air openings 35A, 35B are arranged into connection with separate chambers 33A, 33B, respectively. Then, the jet pressure of the air jets 36B, 36A being in the forward and reverse direction with the travel direction of the web, respectively, can be adjusted independent from each other, which can be advantageous in the precise adjustment of the cutting process. The friction element is arranged on the sides of the chambers 33A, 33B on the web side such that it comes in contact with the web and forms a vacuumizing air pocket from the effect of the air jets 36A, 36B. Of its other parts, the arrangement corresponds with the arrangement shown in FIG. 2A.

In the illustrated examples, the chamber 23 (33A, 33B) together with the air openings 25A, 25B (35A, 35B) and the flow-preventing plates 24A, 24B (34A, 34B) form the blowers 21A, 21B (31A, 31B). The production of compressed air and its connection to the chamber 23 (33A, 33B) are not described here in more detail.

The distance of the upper and lower air openings 25A, 25B from each other and thus the dimension of the friction element in the direction defined by the air openings 25A, 25B is advantageously as small as possible, still such that the sufficient vacuumized air pocket and friction effect are provided. Typically, the distance is 2-10 cm.

Figure 2C:
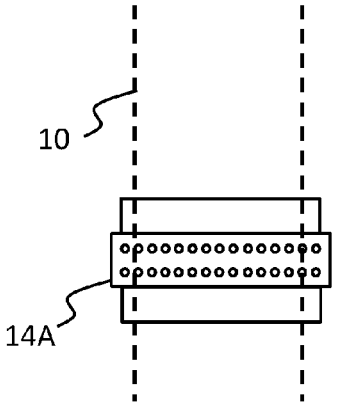
FIGS. 2C-2E show cross sections in the direction of the web plane of various positions of the device according to the invention in relation to the web in accordance with different embodiments.
Figure 2D:
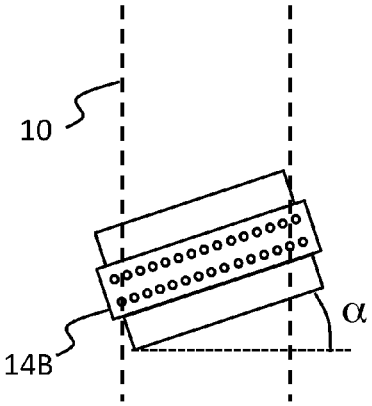
Figure 2E:
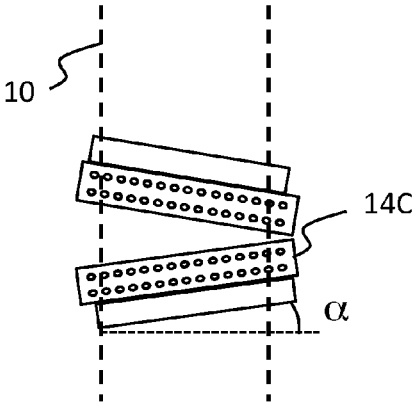

FIG. 2C shows an air cutting device 14A positioned at a right angle in relation to the travel direction of the web 10. FIG. 2D shows an air cutting device 14B positioned at an angle $\alpha$ diverted on the plane of the web 10 in relation to the travel direction of the web 10. The angle $\alpha$ can be ±0 . . . 45 degrees. FIG. 2E shows an air cutting device 14C the upper and lower sections of which are positioned both independent from each other (e.g. implemented by a structure similar to the one in FIG. 2B) at an angle $\alpha$ diverted on the plane of the web 10 in relation to the travel direction of the web 10. The angle $\alpha$ can also in this embodiment be ±0 . . . 45 degrees The diversion of the device or its section on the plane of the web is advantageous e.g. if, after cutting, the tail is wished to be guided aside from its original machine-directional line.

Figure 2F:
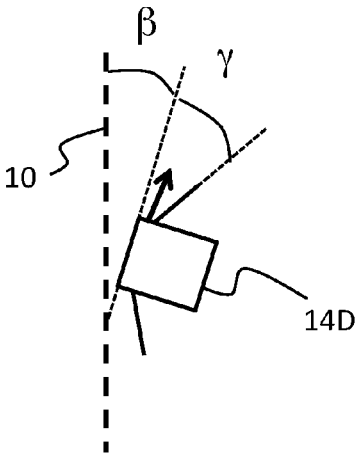
FIG. 2F shows a cross-sectional side view of the position of a device according to an embodiment in relation to the web and an angle of a flow-preventing plate in relation to a blow start direction.

Furthermore, FIG. 2F shows an arrangement in which an air cutting device 14D has been diverted from the plane of the web (the original income plane of the web) out for an angle $\beta$. The angle $\beta$ can also be ±0 . . . 45 degrees. Such an arrangement is advantageous e.g. when it is desired to guide the tail strongly after the cutting by means of an upper blow.

The angular positions in accordance with FIGS. 2C-2F can be freely combined to provide a desired effect without diverging from the idea according to the invention in which the blows are arranged at least mainly in the travel direction of the fibrous web to obtain a desired manipulation effect.

It is sufficient that, in a two-blower arrangement, one of the blows sucks the web fast to the friction element and thus increases kinetic friction between it and the web. The other blow can have been arranged e.g. only for cutting. In a typical arrangement however, both blows take part at least at some stage of the cutting process for both increasing the friction effect and the cutting.

Figure 3A:
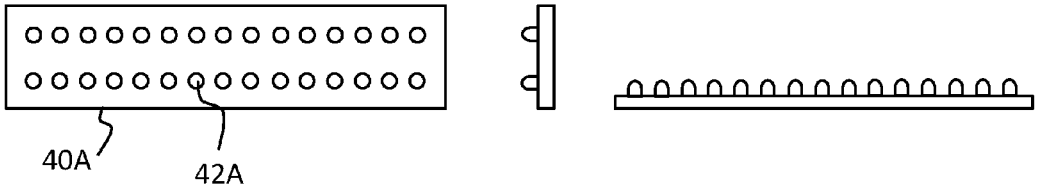
FIGS. 3A-3D show orthogonal cross-sectional views of alternative implementations of a friction element.
Figure 3B:
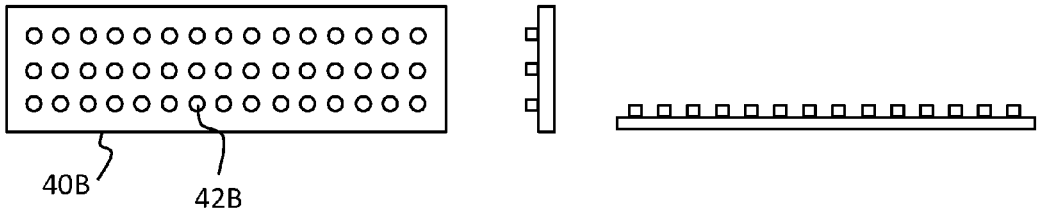
Figure 3C:
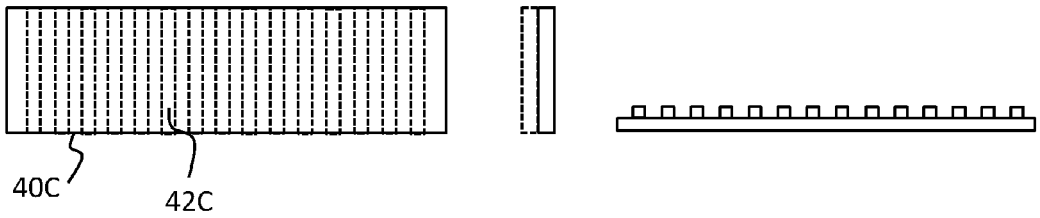

A profile of the friction element providing a desired effect can be formed in many ways and some ways have been illustrated in FIGS. 3A-3D as examples. The arrangement shown in FIG. 3A corresponds with the arrangements shown in FIGS. 2A and 2B. Here, projections 42A are arranged on a base plate, which can also be a wall of the chamber, in two rows at a distance from each other. FIG. 3B shows an equivalent arrangement in which projections 42B are arranged in three rows onto a base plate 40B. FIG. 3C shows an alternative arrangement in which projections 42C comprise elongated elements in the travel direction of the web, whereby several elongated vacuumized air pockets are formed in zones defined by the web, a base plate 40C and the projections 42C.

Figure 3D:
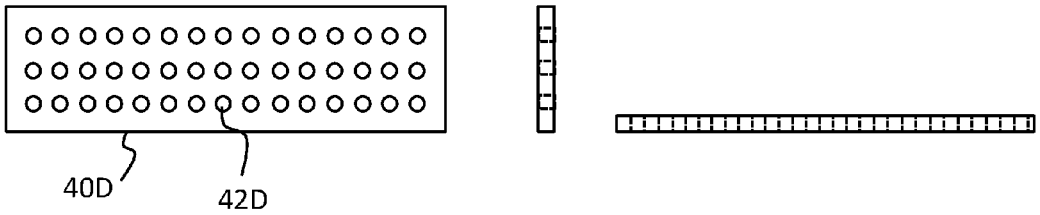

FIG. 3D shows an arrangement different from the previous ones in which openings 42D instead of projections have been formed on a base plate 40D. When such a plate is arranged in accordance with FIG. 4C by means of suitable separator elements 99A, 99B at a distance from the wall of an air chamber 93 of a blower 91 as a friction element 98, a vacuumized air pocket is formed between this and the chamber similar to the previous embodiments. Via the openings 42D, the web tends to be sucked against the base plate 40C and further 'through the openings', whereby friction force increases.

In all of the above arrangement examples, the general form of the friction element is a plane in the direction of the web the detailed profile of which still differs from the planar i.e. even profile. It is possible to combine the above-described arrangements or to construct other arrangements with equivalent effects.

Figure 4A:
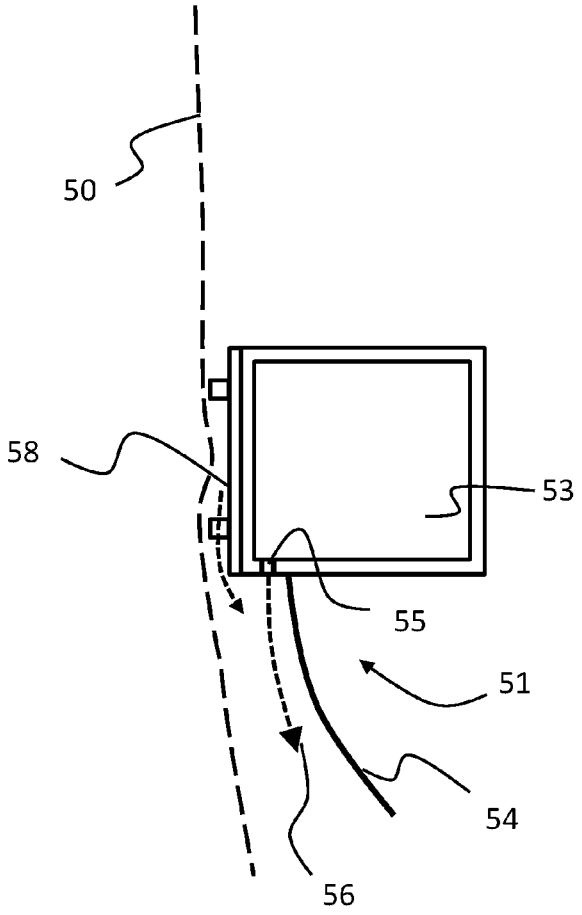
FIGS. 4A-4C show cross-sectional side views of further implementations of the device according to the invention.

FIG. 4A shows a 'one-sided' blower device for manipulating a fibrous web 50 but still being according to the invention. Its structure corresponds to that of the device shown in FIG. 2A but it comprises only one blower 51, i.e. air openings 55 and a flow-preventing plate 54, only on one side of a chamber 53 to provide one air jet 56. In this case also, the blower 51 and a friction element 58 provide a desired vacuum effect increasing friction in the range of the friction element 58. Such a device is suitable for e.g. the guiding, deceleration or tightening of board webs.

Figure 4B:
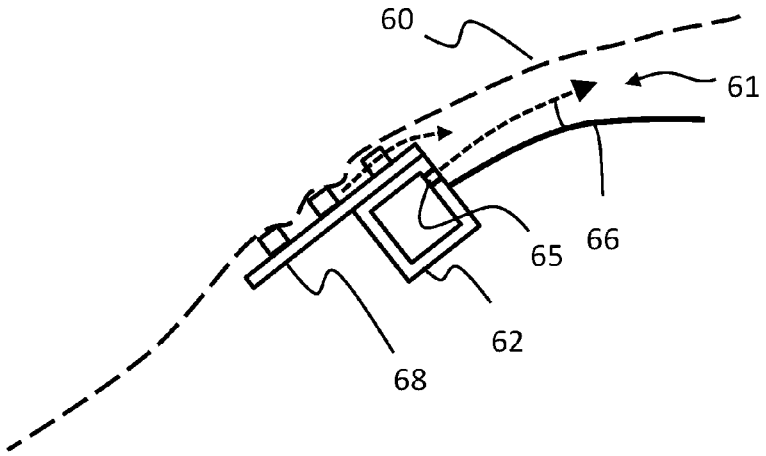
Figure 4C:
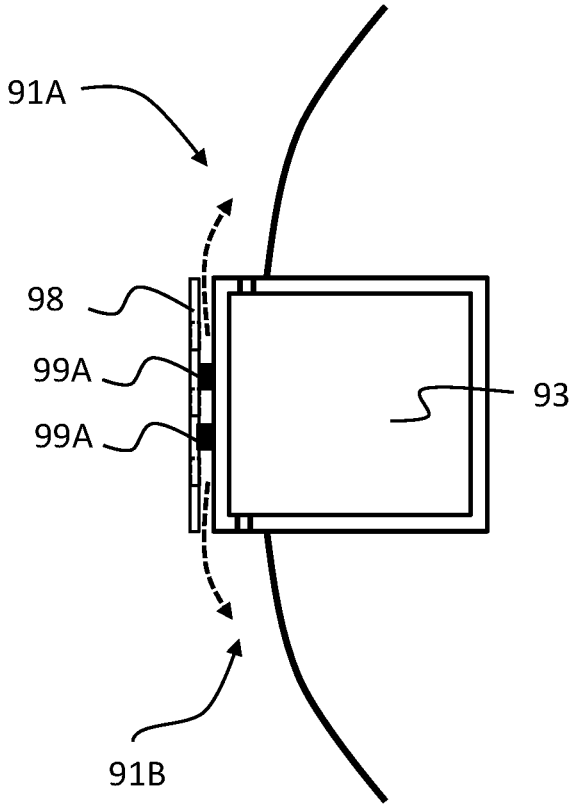

FIG. 4B shows a further variation in which a blower 61 comprises a blowing chamber 62 which is still smaller than a friction element 68 of its dimension in the direction of the web. Here, the friction element 68 is a plate having three rows of projections. An air jet 66 is directed from air openings 65 obliquely in relation to the vertical direction but substantially in the direction of a web 60 to guide, decelerate or tighten it.

As it is evident from the above description, the present invention can be implemented in many different ways only some of which have been depicted here. The device according to the invention can be fitted as part of various tail-conveyance, tail-cutting and/or tail-threading apparatus units, whereby e.g. the strengths of blows can be adjusted and the flow-preventing plates and friction elements shaped according to the requirements of each apparatus.

According to an embodiment, the present manipulating device forms one uniform device unit i.e. its different parts are connected to each other such that the device is easily transferable and positionable at a desired point as one unit.

The width of the device (the dimension in the direction of the web width) is typically arranged to correspond the web to be manipulated or it is slightly larger than that. The width can be e.g. 5 cm-10 m, in the case of the tail typically 5-40 cm.

The production device or devices of air pressure, such as compressors, connectable to the device and their control units are available prior art for those in the field and they are not discussed here in more detail.

Even though the invention and its embodiments were above described mainly in connection with tail cutting, they can also be used in other stages of the tail-threading process for manipulating the tail or for manipulating other webs, even full-width webs, in the tail-threading section or other sections of the fibrous-web machine.

The invention claimed is:

1. A device for cutting a fibrous web in motion along a motion direction, which device comprises a first blower provided with a first flow-preventing element, said first blower made to produce a first blow from one or more first outlet openings, the first blow having a blow direction substantially opposite to the motion direction of the fibrous web, said first flow-preventing element comprises a first flow-preventing plate located at least partially at an angular position in relation to the travel direction of the web, a second blower provided with a second flow-preventing element to produce a second blow from one or more second outlet openings, the second blow having a second blow direction substantially in the direction of the motion direction of the fibrous web, said second flow-preventing element comprises a second flow-preventing plate located at least partially at an angular position in relation to the travel direction of the web, a friction element against which the fibrous web is arranged to be pressed at least partially due to the effect of said blows and flow-preventing elements due to the Coanda effect which causes a force component directed at the fibrous web perpendicular to a plane of the fibrous web to press the web against the friction element to apply a friction force to the fibrous web, the friction force resisting the motion of the fibrous web and decelerating the fibrous web, whereby the first and second blows are adapted to cut the decelerated fibrous web, whereby the friction element is located between the first and the second blower, whereby the blows are directed substantially away from said friction element such that at least a majority of the friction element is located on the backside of a plane defined by the outlet openings and the blow direction of each blow, and the friction element comprises a surface profile which deviates from a planar one and due to the effect of said blows and flow-preventing elements, a continuous underpressure is provided on the surface of the fibrous web on the side of the fibrous web that faces the friction element even when the fibrous web contacts the friction element during said pressing.

2. A device according to claim 1, wherein the surface profile is arranged such that said first and second blows create a continuous underpressure between the fibrous web and the friction element.

3. A device according to claim 1, wherein the surface profile comprises several projections against which the fibrous web is arranged to be pressed, whereby an air channel remains between the fibrous web and the surface profile for maintaining said underpressure.

4. A device according to claim 3, wherein said projections are arranged on the friction element in two dimensions.

5. A device according to claim 1, wherein the whole friction element is located on the backside of a plane defined by the outlet openings and the blow direction of each blow.

6. A device according to claim 1, wherein said first and second blowers comprise a common air-supply channel and said friction element is arranged substantially between the common air-supply channel and the fibrous web.

7. A device according to claim 1, wherein said first and second blowers are arranged to produce blows substantially equal in strength.

8. A method for manipulating a fibrous web in a tail-threading section of a fibrous-web machine, the method comprising conveying the fibrous web in the vicinity of a first blower and a second blower, each of said blowers provided with one or more openings and a flow-preventing element, wherein the flow preventing elements comprise a first flow preventing plate and a second flow preventing plate each located at least partially at an angular position in relation to the travel direction of the web, such that the first and second blows produced by the first and second blowers from said openings create a force component perpendicular to a plane of the fibrous web to the fibrous web, whereby the first blower is arranged to produce the first blow at least mainly opposite to the motion direction of the fibrous web and the second blower the second blow at least mainly in the direction of the motion direction of the fibrous web, and applying a friction force resisting motion of the fibrous web to the fibrous web by a friction element which is located between said first blower and second blower in the motion direction of the fibrous web, whereby the blows of the blowers are directed substantially away from said friction element such that at least a majority of the friction element is located on a backside of a plane defined by the outlet openings and the start direction of each blow, and whereby the blows cause together a continuous underpressure on the surface of the fibrous web facing the friction element at least partially due to the Coanda effect whereby the friction force decelerates the fibrous web and said first and second blows cutting the fibrous web for tail-threading, and using as said friction element an element which has a surface profile deviating from a planar one.

* * * * *